US006840281B1

(12) United States Patent
Amidzich

(10) Patent No.: US 6,840,281 B1
(45) Date of Patent: Jan. 11, 2005

(54) LIQUID FLOW PRESSURE REDUCER AND METHOD

(75) Inventor: Bradford G. Amidzich, Oconomowoc, WI (US)

(73) Assignee: Vent-Matic Company, Inc., Milwaukee, WI (US)

( * ) Notice: Subject to any disclaimer, the term of this patent is extended or adjusted under 35 U.S.C. 154(b) by 230 days.

(21) Appl. No.: 09/993,103

(22) Filed: Nov. 6, 2001

(51) Int. Cl.[7] ..... F15D 1/02

(52) U.S. Cl. ..... 138/42; 138/40; 138/37; 366/338; 222/396; 222/547; 239/432; 239/590.5

(58) Field of Search ..... 138/42, 37, 39, 138/40; 366/338, 339; 222/564, 547, 396; 137/170.1; 239/432, 590, 590.5

(56) References Cited

U.S. PATENT DOCUMENTS

| | | | | |
|---|---|---|---|---|
| 733,954 A | | 7/1903 | Frederick | 251/231 |
| 1,091,552 A | | 3/1914 | Westerberg | 239/26 |
| 1,964,836 A | | 7/1934 | Wheaton | 137/156 |
| 2,132,011 A | | 10/1938 | Bennet et al. | |
| 2,188,783 A | | 1/1940 | Voight | 251/231 |
| 2,852,042 A | * | 9/1958 | Lynn | 138/38 |
| 3,386,700 A | | 6/1968 | Greene et al. | 251/175 |
| 3,643,927 A | * | 2/1972 | Crouch | 366/337 |
| 3,704,006 A | * | 11/1972 | Grout et al. | 210/758 |
| 3,827,888 A | * | 8/1974 | Terwilliger et al. | 430/616 |
| 3,985,165 A | * | 10/1976 | Tamir et al. | 141/21 |
| 4,034,964 A | * | 7/1977 | Larson | 366/338 |
| 4,210,172 A | | 7/1980 | Fallon et al. | 137/504 |
| 4,255,124 A | * | 3/1981 | Baranowski, Jr. | 431/353 |
| 4,408,893 A | * | 10/1983 | Rice, III | 366/339 |
| 4,522,504 A | * | 6/1985 | Greverath | 366/339 |
| 4,711,376 A | | 12/1987 | Manfroni | 222/146.1 |
| 4,720,076 A | | 1/1988 | Hyde | 251/122 |
| 4,742,942 A | | 5/1988 | Dokos et al. | 222/501 |
| 4,840,493 A | * | 6/1989 | Horner | 366/339 |
| 4,850,705 A | * | 7/1989 | Horner | 366/339 |
| 4,979,647 A | | 12/1990 | Hassell | 222/146.6 |
| 5,062,548 A | * | 11/1991 | Hedderick et al. | 222/190 |
| 5,072,853 A | | 12/1991 | Shannon | 222/1 |
| 5,225,168 A | * | 7/1993 | Khosla | 422/135 |
| 5,307,867 A | * | 5/1994 | Yasuda et al. | 165/109.1 |
| 5,320,424 A | * | 6/1994 | Annett et al. | 366/8 |
| 5,397,180 A | * | 3/1995 | Miller | 366/338 |
| 5,480,589 A | * | 1/1996 | Belser et al. | 261/76 |
| 5,566,851 A | | 10/1996 | Sasaki et al. | 222/105 X |
| 5,794,823 A | | 8/1998 | Roundtree | 222/400.7 |
| 5,845,501 A | | 12/1998 | Stonehouse et al. | 62/62 |
| 5,979,794 A | * | 11/1999 | DeFillipi et al. | 239/135 |
| 6,062,492 A | * | 5/2000 | Tudor et al. | 239/296 |
| 6,364,218 B1 | * | 4/2002 | Tudor et al. | 239/290 |

FOREIGN PATENT DOCUMENTS

| | | |
|---|---|---|
| DE | 7340692 U | 5/1974 |
| DE | 19802291 | 8/1999 |

* cited by examiner

*Primary Examiner*—Patrick Brinson
(74) *Attorney, Agent, or Firm*—Boyle Fredrickson Newholm Stein & Gratz S.C.

(57) ABSTRACT

A pressure reducer is configured for use in a liquid delivery system that requires its liquid contents to be pressurized to a first, relatively high pressure but also requires that the liquid be delivered to a downstream location such as a faucet at a second, relatively low pressure. The pressure reducer reduces the pressure of the flowing liquid by repeatedly imparting directional changes to the liquid. Preferably, the pressure reducer comprises a stationary restrictor having multiple aligned segments, each of which is configured to divide the liquid into two or more diverging streams and to recombine the streams at the end of the segment. Each segment preferably comprises a curved blade having opposed generally toroidal surfaces that border one of two divided liquid streams. The device may be located either remote from or adjacent to the faucet or other terminal point of the system and can include either a single passage or multiple parallel passages. A desired pressure drop can be obtained with high precision simply by properly selecting the configuration and/or number of segments in the device.

23 Claims, 6 Drawing Sheets

LIQUID FLOW PRESSURE REDUCER AND METHOD

BACKGROUND OF THE INVENTION

1. Field of Invention

The present invention relates to the delivery of pressurized liquids, and, more particularly, to a method and device for reducing the pressure of a liquid flowing through a pressurized liquid system to a desired level.

2. Discussion of Related Art

In a liquid delivery system, it is often necessary to initially increase the line pressure in the system to a relatively high level and to subsequently decrease the line pressure at a downstream location in the system. "Line pressure" can be considered the pressure in a line or other flow path connecting a pressurized source to a downstream point in the system. The need for a relatively high initial line pressure and a lower downstream line pressure is especially evident in typical beverage delivery systems, which dispense liquid from a source located some distance from, and often underneath, the liquid outlet. The liquid must be pressurized to overcome gravitational forces and head losses that resist liquid flow from the liquid source to the liquid outlet. Furthermore, when the liquid to be dispensed at the outlet is carbonated, such as with beer or soda, the liquid must also be kept under pressure to prevent a loss of carbonation. However, the initial line pressure required for the system is often too high for proper subsequent dispensation at the outlet or other ultimate use of the liquid. This overpressurization is particularly detrimental in the field of carbonated beverage delivery because the overpressurization at the system's faucet will cause the liquid to be dispensed at a higher-than desired velocity, resulting in the dispensing of an overly-foamy beverage.

Prior art beverage dispensing systems that have addressed these problems have reduced line pressure by relying on head losses within an additional tubing section. Specifically, in some beer dispensing systems, the system is shipped to an intended installation with a standard length of Mayon tubing (typically 4.5') as well as a standard additional length or "coolant loop" of copper tubing designed to provide the head losses required of a "typical" system. Then, the length of additional tubing actually required to create the correct restriction for that particular installation is determined, and the "standard" system is modified as necessary to provide the required restriction for that installation. In about 75% of systems, the "standard" restriction is inadequate, and as much as an additional 20' of Mayon tubing must be installed in the system. The existing copper tubing coolant loop leads must be lengthened by means of soldering on extensions to match the length of Mayon tubing. The Mayon tubing is then secured to the coolant leads first with filament tape and then with a polymer tape. The coolant lines and Mayon tubing bundle are then insulated from the bottom of the dispensing head to the end of the leads with six foot sections of Armaflex insulation, and the seams of the Armaflex are glued and taped together. If less than "standard" restriction is required, some Mayon tubing must be removed from the system, and the coolant leads must be shortened to match the Mayon tubing. The tubing must then be taped and insulated as described above.

It can thus be seen that the extra tubing is cumbersome to use, especially in installations in which many liquid lines must be placed in a relatively small area, as in many taverns. It is also difficult to install. These problems are especially severe in systems having beer pumps. These systems typically operate at a minimum pressure of 25 psig and often supply beer to multiple faucets through a multi-way manifold. The constant applied pressure leads to a reduction in flow. Additional restriction therefore is required to maintain the natural carbonation level of the products within the system to avoid breakout of the carbon-dioxide from the beverage and resulting foaming at the faucet.

Hence, the need has arisen to provide a pressure reducer for a fluid delivery system that is compact and simple in construction, that is easy to install, and that can be easily tailored to meet the pressure reduction needs of a particular system.

SUMMARY OF THE INVENTION

The present invention relates to a simplified method and apparatus for obtaining a desired pressure drop in a liquid flowing through an enclosed path of a fluid delivery system. Instead of employing an extra length of coil or a complex variable or fixed orifice flow restrictor, the present invention employs a special type of pressure reducer within the flow path to achieve the desired reduction in pressure. Specifically, the device is configured to impart repeated directional changes to liquid flowing through the path. The directional changes necessarily reduce the liquid's momentum, hence reducing its pressure. Preferably, the pressure reducer includes a stationary restrictor that repeatedly splits the liquid into multiple (at least two) liquid streams, recombines the divided streams, then divides the recombined streams, etc. In a preferred embodiment, the restrictor includes a plurality of flow divider segments that are located within the passage and that are each configured to sequentially divide liquid flowing therepast into multiple liquid streams and to recombine the multiple liquid streams while causing the flowing liquid to change directions. Preferably, the flow divider segments are arranged in a pattern such that the segments alternate between segments having a first directional curvature and segments having a second directional curvature. Each of the segments may comprise a generally helically curved blade having a leading edge, a trailing edge, and opposed curved surfaces, each of which is configured to border one of the liquid streams. The curved blades are arranged end-to-end such that the trailing edge of each curved blade extends at least generally perpendicularly to the leading edge of an adjacent downstream blade.

The pressure reducer has the advantage of being much smaller than extra coils of liquid line. A desired pressure drop can be obtained with high precision simply by properly selecting the configuration and/or number of segments in the restrictor. The pressure reducer of the present invention is also relatively easy to incorporate into existing liquid delivery systems.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

A pressure reducer is provided for use in a liquid delivery system that requires its liquid contents to be pressurized to a first, relatively high pressure but also requires that the liquid be delivered to a downstream location such as a faucet at a second, relatively low pressure. The pressure reducer reduces the pressure of the flowing liquid by repeatedly imparting directional changes to the liquid. Preferably, the pressure reducer comprises a restrictor formed from a plurality of aligned segments, each of which is configured to divide the liquid into two or more diverging streams and to recombine the streams at the end of the segment. Each segment preferably comprises a curved blade having opposed generally helical surfaces that border one of two divided liquid streams. The device may be located either remote from or adjacent the faucet or other terminal point of the liquid delivery system and can include either a single passage or multiple parallel passages. Each embodiment preferably comprises a section that helps straighten flow at the end of the pressure reducer.

2. Description of First Preferred Embodiment

Figure 1:
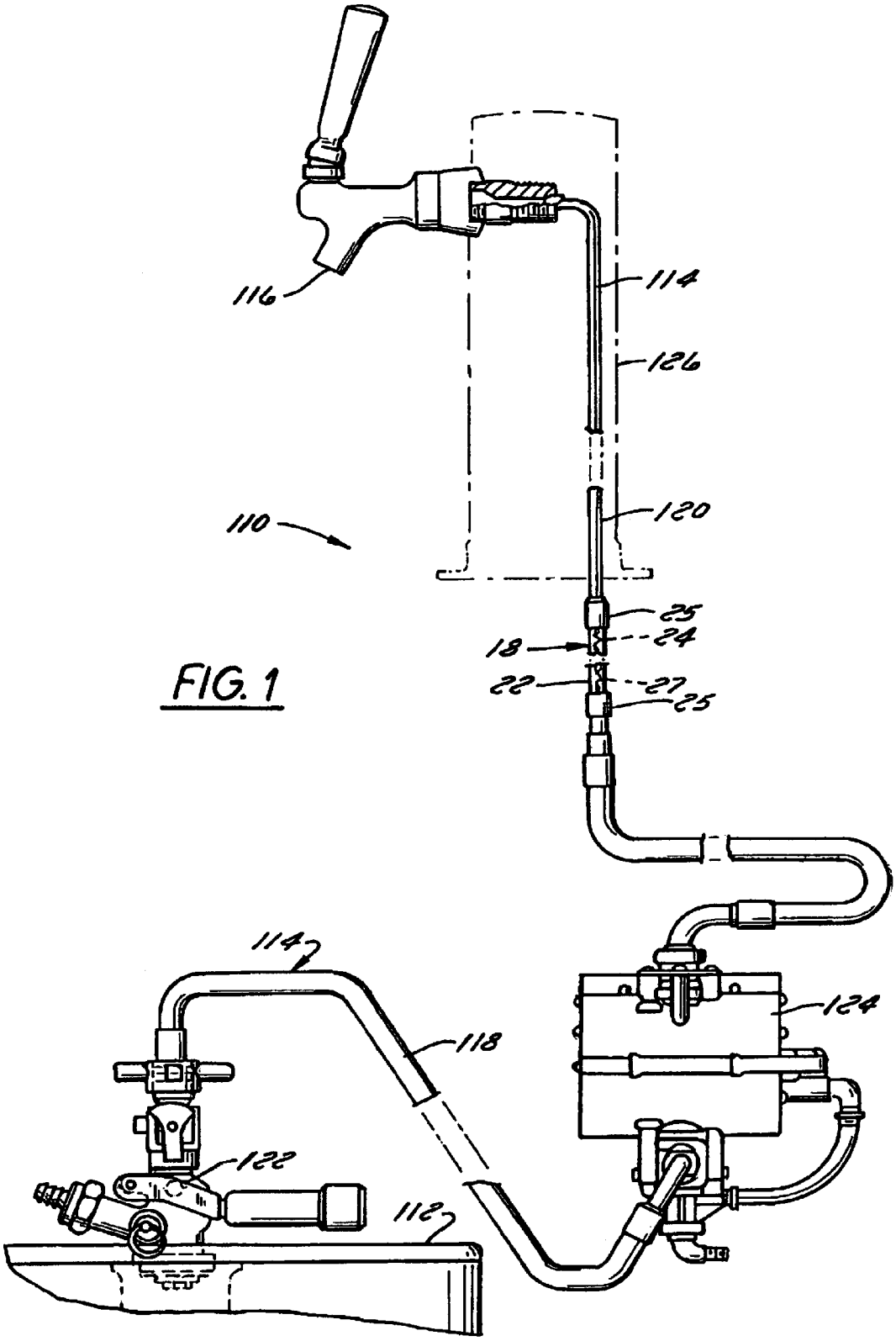
FIG. 1 is a partially sectional side elevation view of a pressurized liquid dispensing system forming an example of a liquid delivery system constructed in accordance with a first preferred embodiment of the present invention and having a pressure reducer located at a distance from a faucet of the system.

Referring to FIG. 1, a pressurized liquid delivery system 110 incorporating a pressure reducer constructed in accordance with a first preferred embodiment of the invention comprises a liquid source 112, a liquid line 114, and a destination 116. The components 112, 114, and 116 may differ widely depending on the application. In the illustrated embodiment in which the system is configured to dispense beer, 1) the source 112 comprises a barrel, 2) the line 114 comprises a relatively long trunk housing 118 and a shorter standard tubing section 120 at the downstream end of the line 114, and 3) the destination comprises a dispensing faucet 116. The barrel 112 is a standard pressurized barrel having a dispensing coupling 122. The trunk housing 118 comprises a line imbedded in a liquid-cooled casing in a known manner. A volumetric pump 124 is located in the trunk housing 118 adjacent the barrel 112 and is configured to pump beer from the barrel 112 to the dispensing faucet 116 at a designated pressure rated to obtain a desired volumetric flow rate at the faucet 116. The dispensing faucet 116 may be located remote from the barrel 112 (sometimes in excess of 300 feet) and is mounted on a dispensing tower 126 extending upwardly from a counter (not shown) at a location with is typically disposed at a substantial distance above the barrel 112. Although only a single faucet 116 is illustrated, many dispensing systems will include multiple faucets, each of which is supplied with beer from a respective barrel and a respective line.

Figure 2:
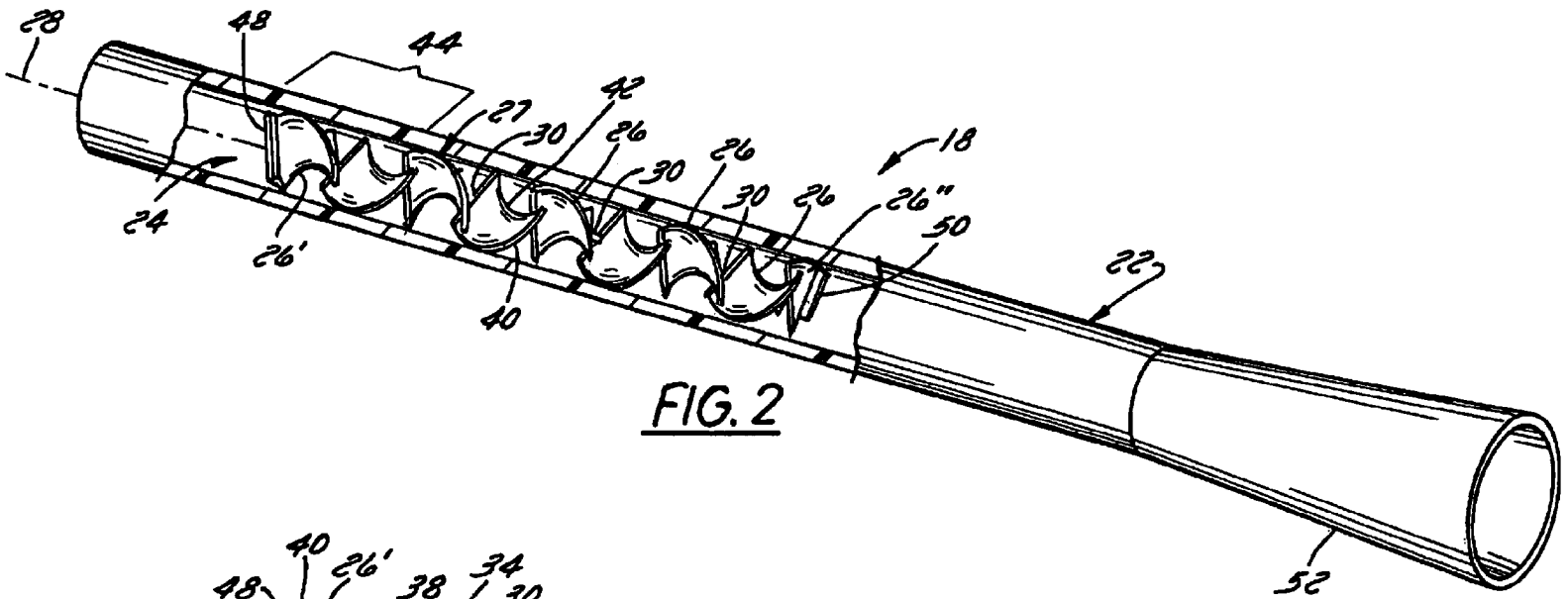
FIG. 2 is a partially sectional perspective view of the pressure reducer shown in FIG. 1.

A pressure reducer 18 is located within the liquid line 114 between the barrel 112 and the faucet 116. It is typically located in the standard tubing section 120 adjacent the dispensing tower 126. It is configured to reduce the line pressure at the faucet 116 sufficiently to obtain a velocity at the faucet 116 that optimizes the flow of beer from the faucet. The pressure reducer 18 of this embodiment has a housing 22 containing a single passage 24 that houses a stationary restrictor 27. The housing 22 is coupled to the tubing sections by a pair of standard unions 25, one of which is located at each end of the housing. The restrictor 27 is configured to impart a pressure drop to liquid flowing through the housing 22 by imparting repeated directional changes to the flowing liquid. In the illustrated embodiment, the restrictor 27 takes the form of a series of sections, each of which includes curved sections 26 distributed along a central axis 28 of the passage 24 as best seen in FIG. 2. The sections 26 are preferably in tight association with the walls of the passage 24 so they do not rotate. The sections 26 are connected to one another by short posts 30 that extend along the central axis 28 and that also separate the blades 26 from one another or, alternatively, could be molded end-to-end with no connecting pegs.

Figure 3:
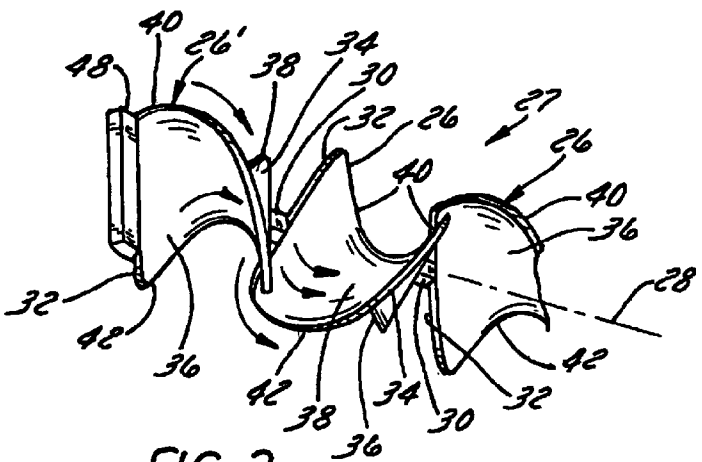
FIG. 3 is an exploded perspective view of a portion of the pressure reducer of FIG. 2.
Figure 4:
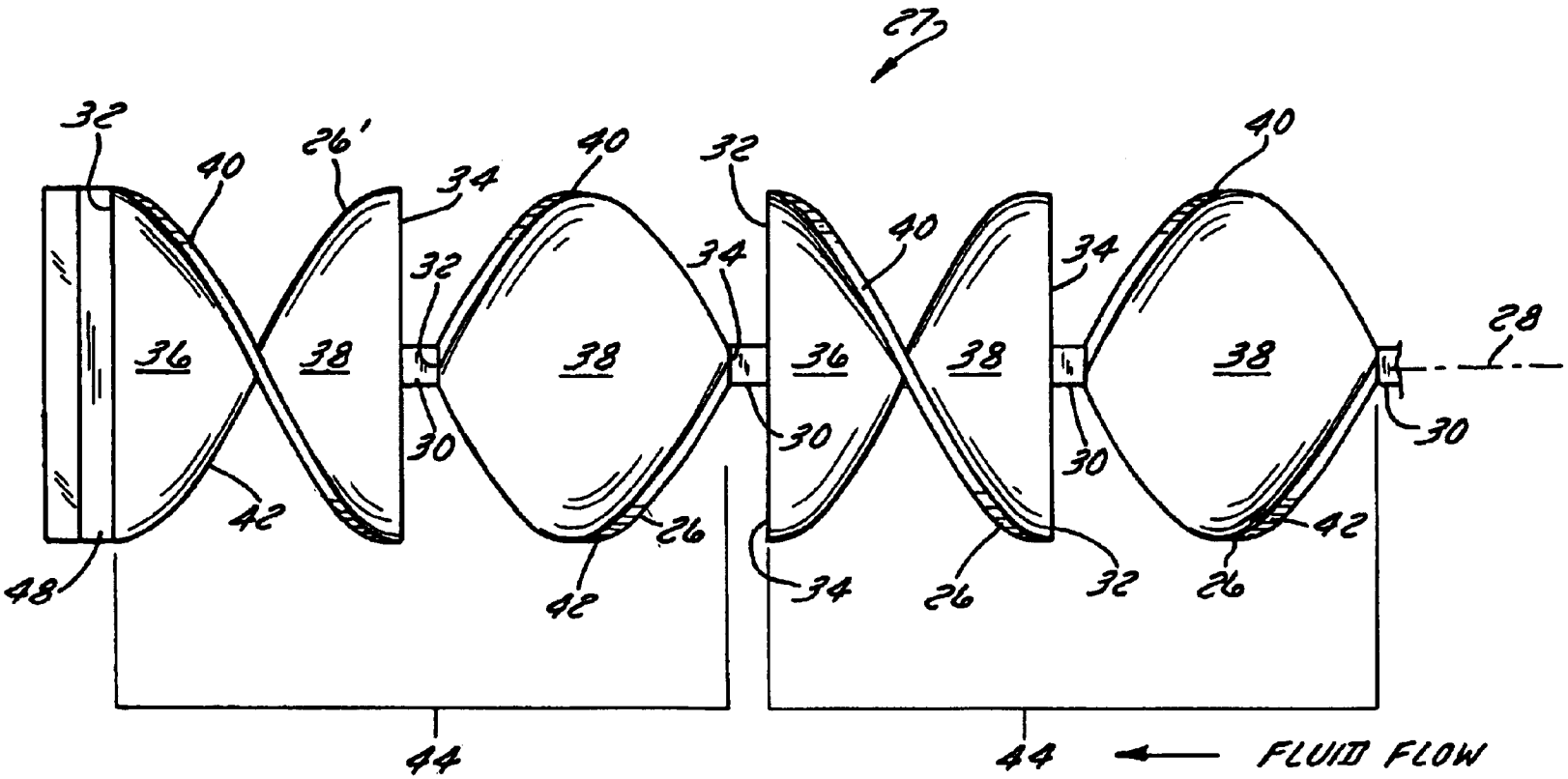
FIG. 4 is a side elevation view of the portion of the pressure reducer of FIG. 3.

As is best seen in FIGS. 3 and 4, each section 26 of this embodiment takes the form of a curved blade and, accordingly will hereafter be referred to as a "blade." Each blade 26 has a leading edge 32 and a trailing edge 34, as well as a first and second opposed side surface 36, 38, and is generally rectangular in shape when viewed in elevation. Between the two edges 32, 34, each blade 26 is twisted in a generally helical or toroidal fashion to make a 180° turn around the axis 28, giving each blade 26 a pair of helical edges 40, 42 and providing each blade 26 with either a clockwise or counterclockwise directional aspect in which the downstream edge 34 extends in parallel with the upstream edge 32. The pitch of each blade 26 is determined by the axial extent required to make the 180° turn. The illustrated blades have a medium pitch, each having a length of 7/32". A structure suitable for use as the restrictor 27, but heretofore designed for use solely as a stationary or motionless mixer, is a mixing rod available from ConPro Tec. Inc. under the tradename Statomix®. See http:/www.mixpac.com. The mixing rod marketed by ConPro is configured to mix streams of epoxy glue or the like so as to dispense an admixture from the end of the device. The mixing rod as used in a pressure reducer in accordance with the invention therefore can be thought of as "a mixing rod restrictor."

The individual blades 26 of the restrictor 27 are arranged in segments 44 of two blades 26 each, and each segment 44 comprises one clockwise curving or "right-hand" blade 26 and one counterclockwise curving or "left-hand" blade 26. In addition, the leading edge 32 of each blade 26 extends at least generally perpendicularly with respect to the trailing edge 34 of the adjacent upstream blade. Referring to both FIGS. 2 and 3, it can be seen that the blade 26' at the most upstream position within the pressure reducer 18 bears a wedge-shaped dividing bar 48 on its leading edge 32. FIG. 2 shows that the blade 26" in the most downstream position bears a similarly shaped recombining bar 50 on its trailing edge 34. Recombining bar 50 also acts a flow straightener that helps straighten flow into downstream portions of the system. It could be replaced or supplemented by a partial blade 26" that curves in the opposite direction of the downstream-most complete blade. In the illustrated embodiment, it is attached to a partial blade 26" forming the downstream end of the restrictor 27. In addition or instead of occurring through operation of the recombining bar 50 and/or the partial blade 26", flow straightening could be accomplished by altering the pitch on the downstream end portion of the downstream-most blade 26". It is also replaced or supplemented by an outwardly-flared section 52 of the housing 22 that is located downstream from the restrictor 27.

In use, when the liquid in the system 110 reaches the dividing bar 48 of the pressure restrictor 27, the dividing bar 48 divides the single liquid stream from the liquid source 112 into two diverging streams. Each stream of liquid passes over one of the curved sides 36, 38 of the blade 26', thus imparting the clockwise directional aspect of the blade 26', on each of the two streams. The two streams reconverge at the downstream edge 38 of the blade 26' and the reconverged stream is quickly split again by the leading edge 32 of the next blade 26 in the series. The next blade 26, having an opposite directional aspect than the one prior to it, imparts an opposite directional flow to each of the liquid streams. The pattern of splitting, clockwise or clockwise deflection, converging, counterclockwise or clockwise deflection, and reconverging continues over each of the segments 44. Initial splitting is facilitated by the dividing bar 48 at the upstream-most end of the device 18, and ultimate recombination and flow straightening are facilitated by the partial blade 26", recombining bar 50, and/or the flared end 52 of the housing 22.

By repeatedly imparting sharp directional changes to the flowing liquid, the relatively short pressure reducer 18 of the present invention produces a pressure drop that is as great as is provided by a dramatically longer piece of tubing. Additional pressure drop results from the repeated splitting and recombining of the liquid streams. The reduction in pressure across the pressure reducer 18 is therefore the sum of 1) the loss of velocity when liquid is required to change courses with every alternating blade 26, 2) the loss of velocity when a liquid stream collides with another liquid stream, and 3) the loss of velocity caused by the increased surface area of the blades. The resulting restriction efficiency is dramatic. In fact, in a typical system, a 6" restrictor provides approximately the same pressure drop as an 18 foot long section of tubing of the type used in prior art systems. Of the three factors discussed above, the directional change is currently considered to be the most important in carrying out the goals of the invention. It should be emphasized, however, that a variety of structures performing any or all of these functions fall within the scope of the present invention.

Figure 7:
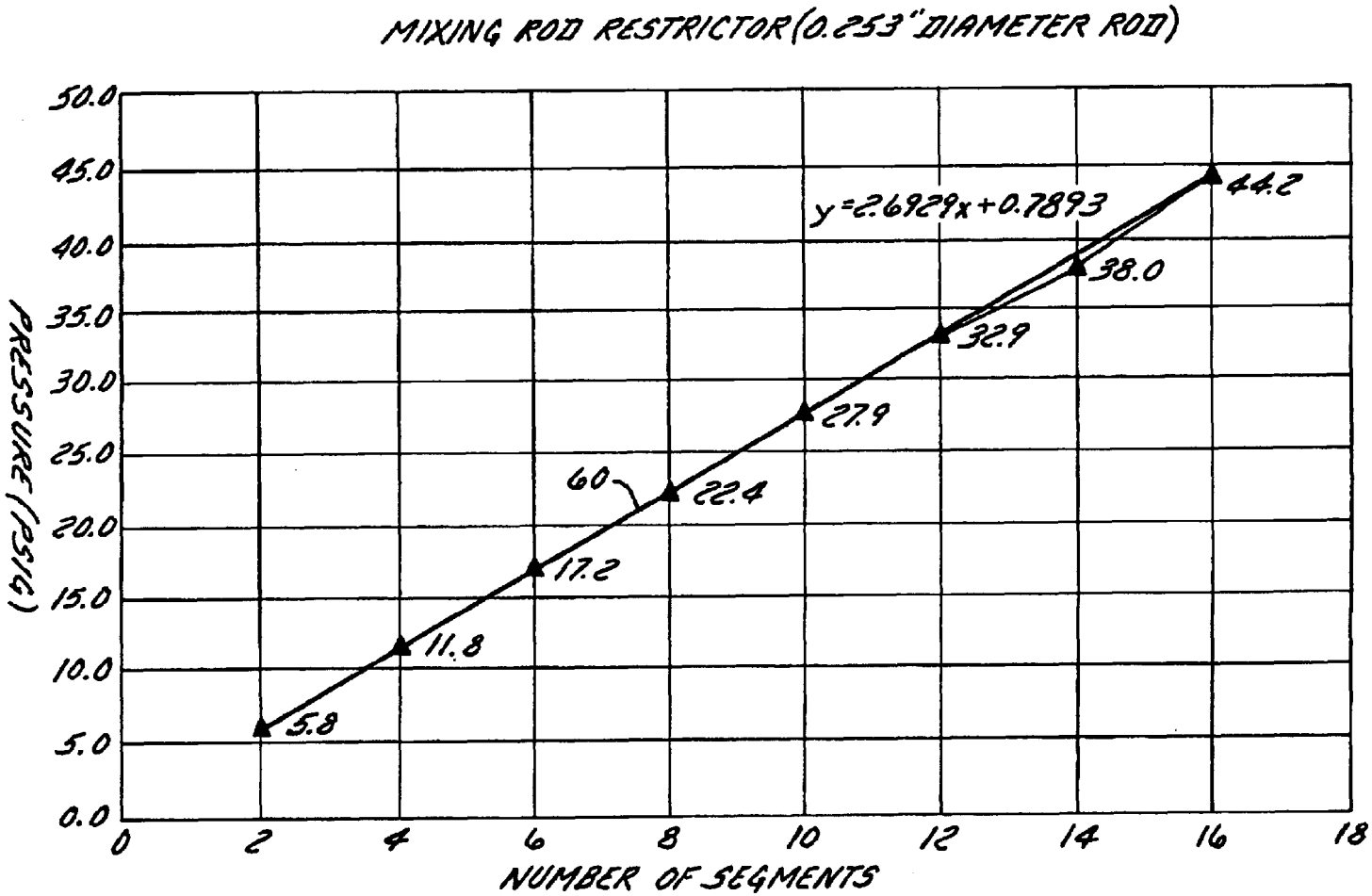
FIG. 7 is a graph illustrating pressure reducer restrictor segment number versus pressure drop for one embodiment of a pressure reducer constructed in accordance with the invention.

The degree of pressure drop imparted by the pressure reducer 18 is determined by the dimension and pitch of the individual blades 26 and by the number of segments 44 in the restrictor 27. Hence, the magnitude of pressure drop can be precisely determined by selecting suitable combinations of blade characteristics and/or segment numbers and by assembling a pressure reducer 18 having the desired physical characteristics. Partial segments 44 or single or even partial blades 26 could also be utilized to further fine tune the pressure drop provided by the device 18. In the simplest case, in which the pressure reducer 18 is made simply by providing a designated number of segments 44 formed from blades 26 of common physical characteristics and by inserting the segments 44 in the housing 22, an experimentally-known correlation can be used to select the desired number segments. One such correlation is illustrated by the curve 60 in FIG. 7, which illustrates pressure drop through a pressure reducer at a volumetric flow rate of 1 gal/min. The pressure reducer has an about a ¼" diameter mixing rod housed in a 0.257" diameter housing. The pressure drop obtained through the use of a given number of restrictor segments is determined by the equation: $y=2.69x+0.79$, where x is the number of restrictor segments and y is the pressure reduction obtained as water flows through the pressure reducer at 1 gal/min. Curve 60 illustrates that about a 7 psig pressure drop can be obtained by selecting two segments 44, about a 19 psig pressure drop can be obtained by selecting six segments 44, etc. The data used to prepare curve 60 is also reproduced in Table 1.

TABLE 1

| Number of Blades | Measured Pressure Drop (PSIG) | Assembly Pressure Drop (PSIG) | Mixing Rod Restriction (PSIG) | Mixing Rod Restriction per Segment |
|---|---|---|---|---|
| 2 | 7.36 | 1.8 | 5.8 | 2.90 |
| 4 | 13.6 | 1.8 | 11.8 | 2.95 |
| 6 | 19.0 | 1.8 | 17.2 | 2.87 |
| 8 | 24.2 | 1.8 | 22.4 | 2.80 |
| 10 | 29.7 | 1.8 | 27.9 | 2.79 |
| 12 | 34.7 | 1.8 | 32.9 | 2.74 |
| 14 | 39.8 | 1.8 | 38.0 | 2.71 |
| 16 | 46.0 | 1.8 | 44.2 | 2.76 |
| | | | AVERAGE | 2.82 |

As an example of calculating the number of segments required for a typical system, assume that the system 110 of FIG. 1 is configured to deliver beer to the faucet 116 from the barrel 112. The ideal system delivers beer at about 1 gal/min at and a velocity of about 19.6 in/sec at atmospheric pressure (lower velocities would undesirably increase the fill time of a container, and higher pressures would render the dispensed beer undesirably frothy). At 1 gal/min, beer flows from a ½" OD (⅜" ID)) line at a velocity of 19.6 in/sec when the line pressure at the faucet is at atmospheric pressure (14.7 psi). As is standard, the pump 124 forces beer into the downstream portions of the trunk housing 118 at a predetermined pressure set to overcome the maximum head losses encountered by a system having 300 feet of ½" OD (⅜" ID) line and having 4.4 psig head losses in the tower. The typical ½" OD tubing used in this type of system exhibits head losses of about 0.033 psi/ft. Hence, the typical pump has an output pressure of about 30 psi ($14.7+4.4+300\times0.033$). If the distance from the pump to the faucet is only 50 feet, the pump 124 would supply an overpressure of about 10 psi. ($85.1-(14.7+4.4+250\times0.033)$). Referring to Table 1 and FIG. 7, the desired pressure drop can therefore be obtained by inserting 3.5 segments into the housing 22.

3. Structure of Second Preferred Embodiment

Figure 5:
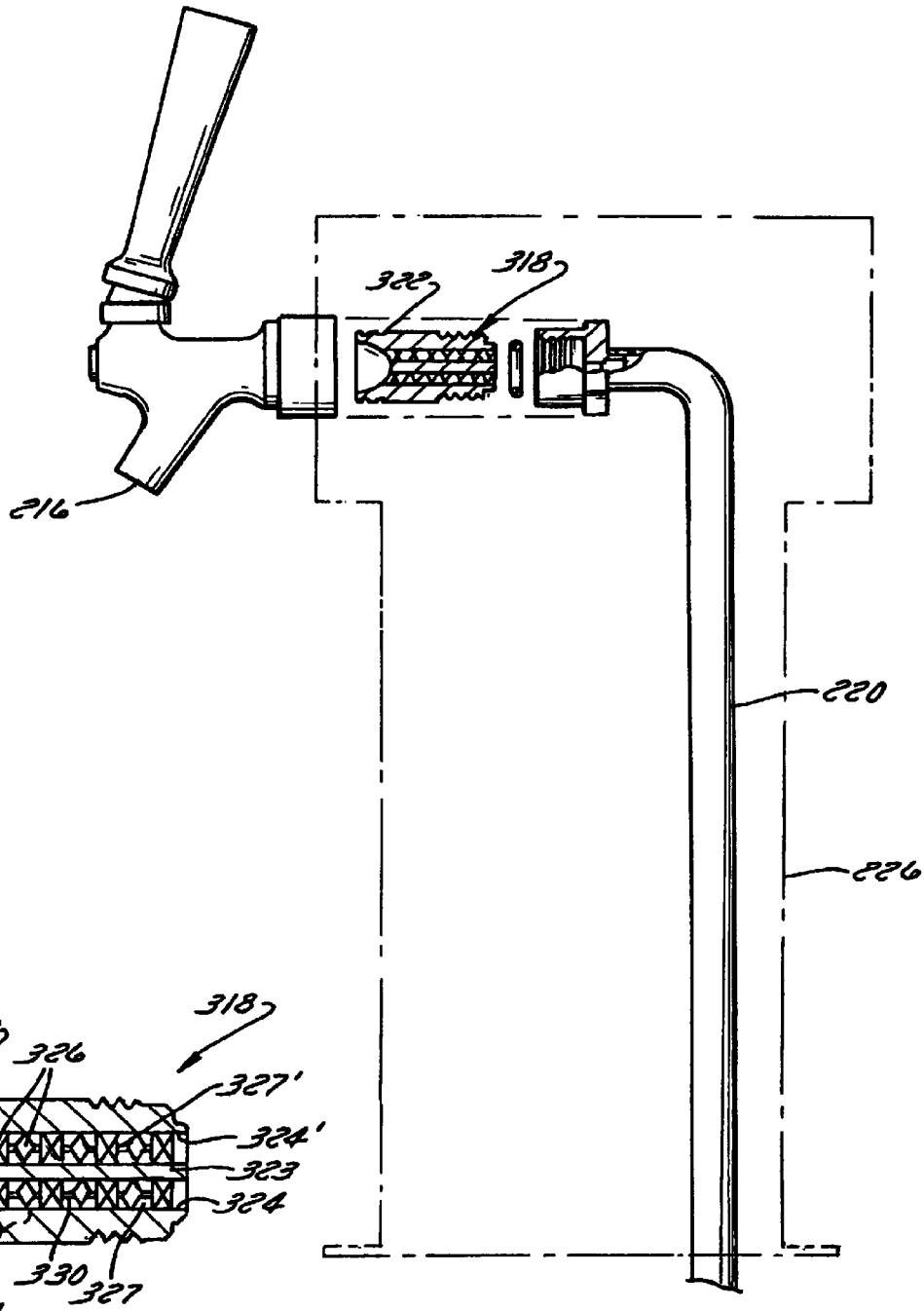
FIG. 5 is a partially sectional side elevation view of a pressurized liquid dispensing system forming a liquid delivery system constructed in accordance with a second preferred embodiment of the present invention and having a pressure reducer located close to the faucet.
Figure 6:
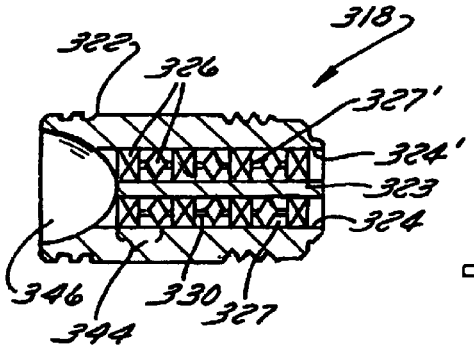
FIG. 6 is a sectional side elevation view of the pressure reducer shown in FIG. 5.

In another embodiment, illustrated in FIGS. 5 and 6, the pressure reducer 318 is located within the upstream end of the outlet 216. As in the first embodiment, the source comprises a barrel, the outlet 216 comprises a faucet mounted on a tower 226, and the line comprises a trunk housing (not shown) and a short line segment 220. Liquid is pumped through the line 214 by a volumetric pump (not shown) connected to the trunk housing.

The pressure reducer 318 of this embodiment has a housing 322 have multiple passages and a separate restrictor in each passage. The illustrated housing has two parallel passages 324 and 324' separated from one another by a central divider 323. Each passage 324 and 324' contains a restrictor 327, 327' formed from a series of restriction blades 326 connected to one another by posts 330 to form interconnected segments 344 of two blades each in the same manner as in the first embodiment. This embodiment can also feature a recombining device 346 to help straighten flow for smoother dispensation at the liquid outlet 216. The recombining device 346 in this embodiment may be a bowl-shaped depression at the downstream end of the housing 322.

The pressure reducer 318 of this embodiment, while being more complex than the pressure reducer 18 of the first embodiment, is short enough to fit within an existing faucet 216 in an existing opening in the tower 226 while providing the same magnitude of pressure drop as the pressure reducer 18 of the first embodiment. The pressure reducer 318 therefore is usable in applications in which the line 214 is inaccessible.

Figure 8:
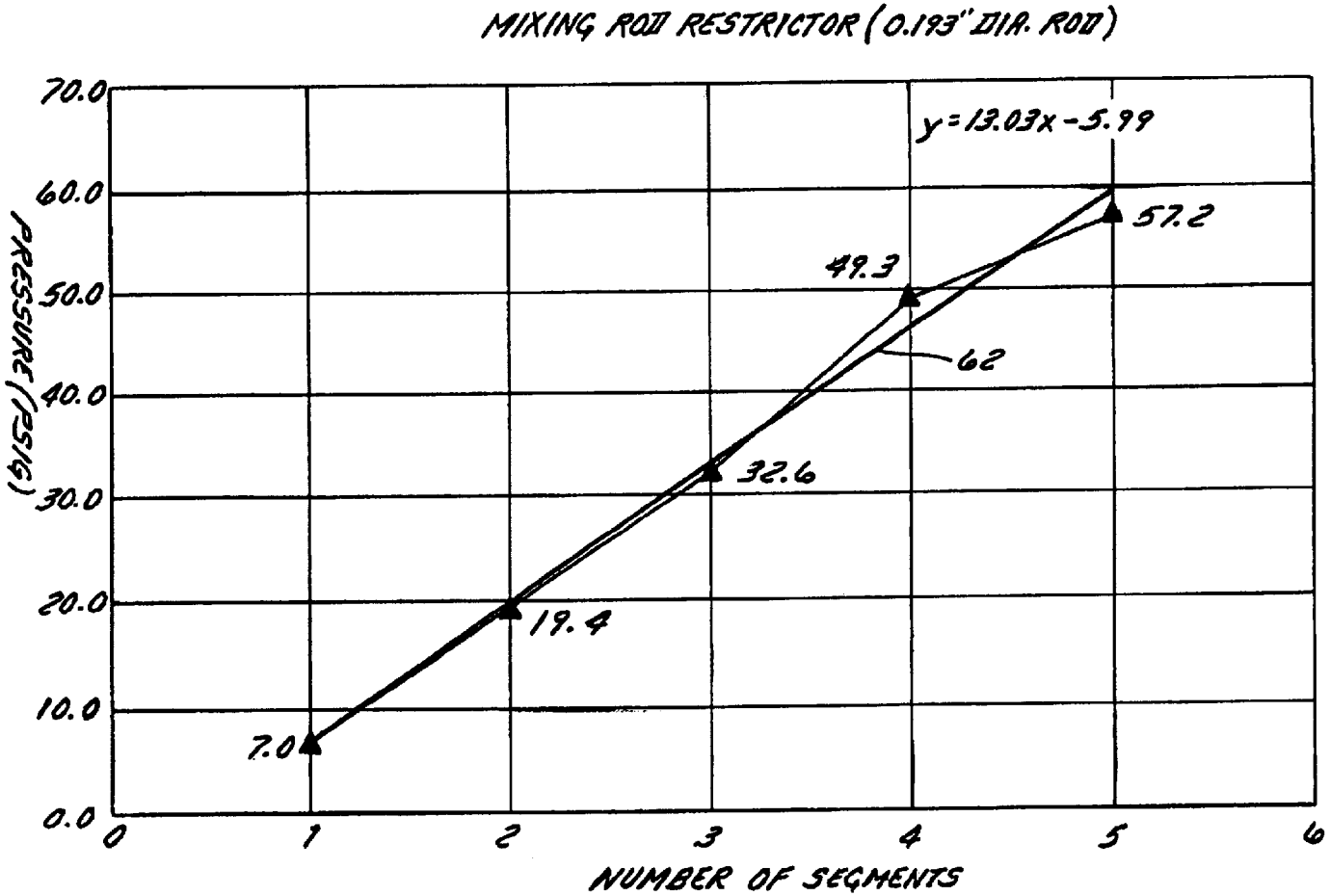
FIG. 8 is a graph illustrating pressure reducer restrictor segment number versus pressure drop for another embodiment of a pressure reducer constructed in accordance with the invention.

The increased pressure drop per unit length afforded by the pressure reducer of this embodiment is due not only to the presence of multiple passages 324 and 324' in the housing 322, but also due to the fact the pressure drop per unit length varies inversely with the diameter of a pressure reducer. Hence, each relatively narrow restrictor 327, 327' produces a larger pressure drop than a wider restrictor of the same length. The effect of rod-diameter variation on per-segment restriction is demonstrated graphically by the curve 62 in FIG. 8, which illustrates pressure drop as water flows through a pressure reducer at 1 gal/min. The pressure reducer has about a 3/16" diameter restrictor rod housed in a 0.195" ID housing. The pressure drop provided by a restrictor having a given number of segments is determined by the equation: $y=13.03x-5.99$, where x is the number of restrictor segments and y is the pressure reduction obtained as water flows through the pressure reducer at 1 gal/min. Specifically, about a 21 total psig pressure drop is obtained with a two-segment restrictor, about a 35 psig total pressure drop is obtained with a 3 segment restrictor, etc. The data from FIG. 8 is tabulated in Table 2:

TABLE 2

| Number of Blades | Measured Pressure Drop (PSIG) | Assembly Pressure Drop (PSIG) | Mixing Rod Restriction (PSIG) | Mixing Rod Restriction per Segment |
|---|---|---|---|---|
| 1 | 9.2 | 2.2 | 7.0 | 7.0 |
| 2 | 21.6 | 2.2 | 19.4 | 9.7 |
| 3 | 34.8 | 2.2 | 32.6 | 10.9 |
| 4 | 51.5 | 2.2 | 49.3 | 12.3 |
| 5 | 59.4 | 2.2 | 57.2 | 11.4 |
| | | | AVERAGE: | 10.3 |

Comparing the different slopes of the curves 60 and 62 reveals that the pressure drop offered by a pressure reducer can be precisely fine tuned not only by incorporating blades of different lengths or different pitches in the same pressure reducer, but also by incorporating blades of different diameters in the same pressure reducer.

Many changes and modifications could be made to the invention in addition to those discussed above. For instance, the inventive pressure reducer could be used in a wide variety of applications other than the dispensing of pressurized beverages. Alternative applications include as a flow restrictor in hydraulic system in which the need exists to reduce the pressure from a main pump to multiple lines serviced by the pump. The restrictor could also take many forms other than illustrated interconnected segments of curved blades, so long as the structure imparts the required repeated directional changes to the flowing liquid. Other changes will become apparent from the appended claims.

I claim:

1. A pressurized liquid dispensing system for dispensing a single liquid, the system comprising:

a pressurized liquid source that is configured to deliver a single pressurized liquid at a first, relatively high line pressure;

a liquid dispenser that is located remote from said liquid source and that is configured to dispense the single liquid at a second, relatively low pressure;

a liquid line connecting said liquid source to said liquid dispenser; and a pressure reducer device within said liquid line, said pressure reducer comprising a housing and a restrictor disposed within said housing, said housing having a single inlet, an outlet, and at least one passage formed between said inlet and said outlet, said restrictor being located in said passage and being configured to impart a series of directional changes to the single liquid, as the single liquid flows through said passage, without mixing the single liquid with any other substance, thereby reducing the pressure of the single liquid to at least approximately said second pressure.

2. A system as recited in claim 1 wherein said restrictor comprises a plurality of flow divider segments located in series within said passage.

3. A system as recited in claim 2, wherein each of said flow divider segments is configured to sequentially divide and change angular direction of a liquid flowing therepast into multiple liquid streams and to recombine said multiple liquid streams.

4. A system as recited in claim 3, wherein each of said flow divider segments comprises a generally helically curved blade having a leading edge, a trailing edge, and opposed curved surfaces, each of which is configured to border one of said liquid streams.

5. A system as recited in claim 4, wherein said curved blades are arranged end-to-end such that, with the exception of a last curved blade of said pressure reducer, the trailing edge of each curved blade extends at least generally perpendicularly to the leading edge of an adjacent downstream blade.

6. A liquid flow pressure reducer comprising:

(A) a housing having a single inlet opening, an outlet opening, and at least one passage formed between said inlet opening and said outlet opening; and (B) a restrictor formed from a plurality of flow divider segments located within said passage, each of said flow divider segments being configured to sequentially divide a single liquid flowing therepast into multiple liquid streams and to recombine said multiple liquid streams while causing the flowing liquid to change directions without mixing the single liquid with any other substance.

7. A pressure reducer as recited in claim 6, wherein said flow divider segments are arranged in a pattern such that said segments alternate between segments having a first directional curvature and segments having a second directional curvature.

8. A pressure reducer as recited in claim 7, wherein each of said segments comprises a generally helically curved blade having a leading edge, a trailing edge, and opposed curved surfaces, each of which is configured to border one of said liquid streams.

9. A pressure reducer as recited in claim 8, wherein said curved blades are arranged end-to-end such that, with the exception of a last curved blade of said pressure reducer, the trailing edge of each curved blade extends at least generally perpendicularly to the leading edge of an adjacent downstream blade.

10. A pressure reducer as recited in claim 6, further comprising a flow divider bar mounted on the leading edge of an upstream-most segment of said restrictor and a flow straightener mounted on the trailing edge of a downstream-most segment of said restrictor.

11. A pressure reducer as recited in claim 6, wherein said housing has a single passage.

12. A pressure reducer comprising:

(A) a housing having an inlet opening, an outlet opening, and a plurality of passages between said inlet opening and said outlet opening; and (B) a restrictor in each passage, the restrictor formed from a plurality of flow divider segments located within said passage, each of said flow divider segments being configured to sequentially divide liquid flowing there past into multiple liquid streams and to recombine said multiple liquid streams while causing the flowing liquid to change directions.

13. A pressure reducer as recited in claim 12, wherein a chamber is provided within said housing toward said outlet opening to allow liquid from each passage to recombine and help straighten flow before exiting said outlet opening.

14. A method of reducing liquid pressure of a single liquid in a pressurized line, the method comprising:

directing a single liquid through said pressurized line; and as the single liquid flows through said pressurized line, deflecting the single liquid through a plurality of repeated directional changes within a generally straight portion of said line without mixing the single liquid with any other substance.

15. A method as recited in claim 14, wherein the deflecting step comprises alternatively deflecting said liquid in a clockwise and counterclockwise rotation as said liquid flows through said generally straight portion of said pressurized line.

16. A method as recited in claim 15, further comprising, as said liquid is flowing through said generally straight portion of said pressurized line, dividing an undivided liquid stream into a first set of multiple streams and deflecting said first set of liquid streams in a first direction;

allowing said first set of multiple liquid streams to converge to form a combined liquid stream having a lower pressure than said undivided stream; then dividing said combined liquid stream into a second set of multiple streams and deflecting said second set of liquid streams in a second direction; and allowing said second set of liquid streams to reconverge to form a recombined liquid stream having a lower pressure than said combined liquid stream.

17. A method as recited in claim 16, wherein:

each of the dividing steps comprises directing a liquid stream over an edge of curved blade positioned within said liquid line, each of the deflecting steps comprises directing a liquid stream over a toroidal major surface of said curved blade, and each of the reconverging steps comprises directing divided liquid streams past a trailing edge of a curved blade and into contact with one another.

18. A method as recited in claim 17, wherein the dividing and converging steps comprise directing liquid past a first blade curved in a first direction and the redividing and reconverging steps comprise directing the liquid past a second curved blade curved in a second direction, said first and second blades being connected to one another in an end-to-end fashion, and a trailing edge of said second segment being positioned at an angle that is offset from an angle of a trailing edge of said first segment by 90°.

19. A method as recited in claim 14, wherein liquid flows through a single passage during the pressure reduction operation.

20. A method of reducing liquid pressure in a pressurized line, the method comprising:

directing liquid through said pressurized line; and, as said liquid flows through said pressurized line, deflecting said liquid through a plurality of repeated directional changes within a generally straight portion of said line, wherein said liquid flows through multiple passages during the pressure reduction operation, said multiple passages having a common inlet and a common outlet, and a separate pressure reduction device being provided in each passage.

21. A liquid dispensing system comprising:

a pressurized liquid source that is configured to deliver a pressurized liquid at a first, relatively high line pressure, the liquid having a gas entrained therein;

a liquid dispenser that is located remote from said liquid source and that is configured to dispense the liquid at a second, relatively low pressure designed to obtain a designated velocity at a designated volumetric flow rate;

a pressure reducer, the pressure reducer comprising a housing and a restrictor disposed within said housing, said housing having a single inlet coupled to said pressurized liquid source, an outlet coupled to said liquid dispenser, and at least one passage formed between said inlet and said outlet, said restrictor being located in said passage and being configured to impart a series of directional changes to the liquid flowing through said passage, thereby reducing the pressure of the liquid flowing through the passage to at least approximately the second pressure in order to dispense the liquid at least approximately the designated velocity.

22. The liquid dispensing system as recited in claim 21, wherein the system is configured to dispense a carbonated beverage, the pressurize liquid source is a source of the carbonated beverage, and the dispenser is a faucet.

23. A method of dispensing a carbonated beverage, comprising:

(A) delivering the carbonated beverage from a pressurized dispenser at a designated initial line pressure;

(B) directing the carbonated beverage through a restrictor so as to reduce the pressure of the carbonated beverage to a value that achieves a designated velocity, said restrictor deflecting the carbonated beverage through a plurality of repeated directional changes within a generally straight portion of said restrictor; then (C) dispensing the carbonated beverage at the designated velocity.

* * * * *